US007449091B2

(12) United States Patent
Du et al.

(10) Patent No.: US 7,449,091 B2
(45) Date of Patent: Nov. 11, 2008

(54) WAFER ELECTROPLATING APPARATUS

(75) Inventors: Chen-Chung Du, Hsinchu (TW); Jen-Rong Huang, Hsinchu (TW); Pang-Ming Chiang, Taipei (TW); Chih-Yuan Tseng, Hsinchu (TW); Muh-Wang Liang, Miaoli Hsien (TW); Chih-Cheng Wang, Hsinchu Hsien (TW); Yi-Chao Weng, Hsinchu Hsien (TW)

(73) Assignee: Industrial Technology Research Institute, Hsinchu Hsien (TW)

( * ) Notice: Subject to any disclaimer, the term of this patent is extended or adjusted under 35 U.S.C. 154(b) by 799 days.

(21) Appl. No.: 11/073,655

(22) Filed: Mar. 8, 2005

(65) Prior Publication Data

US 2006/0137974 A1 Jun. 29, 2006

(30) Foreign Application Priority Data

Dec. 23, 2004 (TW) ..... 93140351 A

(51) Int. Cl.
*B01D 19/00* (2006.01)
*C25B 15/00* (2006.01)

(52) U.S. Cl. ..... 204/234; 96/204

(58) Field of Classification Search ..... 204/234; 96/204; 95/260, 262

See application file for complete search history.

(56) References Cited

U.S. PATENT DOCUMENTS 6,471,756 B1 * 10/2002 Satoh ..... 96/165
2003/0079989 A1 * 5/2003 Klocke et al. ..... 204/471

FOREIGN PATENT DOCUMENTS

JP 2003-277986 2/2003

* cited by examiner

*Primary Examiner*—Alexa D. Neckel
*Assistant Examiner*—Zulmariam Mendez
(74) *Attorney, Agent, or Firm*—Rosenberg, Klein & Lee

(57) ABSTRACT

A wafer electroplating apparatus with a function of bubble removal includes an electroplating bath main body and a fixing device. The electroplating bath main body has an inlet device, a first de-bubble tank and at least an air hole. The fixing device has a second de-bubble tank and an outer shell. The air hole guides gathering bubbles to an outside of the electroplating bath main body so as to remove bubbles. The fixing device can be put into the first de-bubble tank within the electroplating bath main body to form a de-bubble area and is separated easily therefrom to clean the wafer electroplating apparatus. The electroplating bath main body further includes a baffle for rectifying electroplating solution flow before entering the inlet device.

20 Claims, 2 Drawing Sheets

WAFER ELECTROPLATING APPARATUS

RELATED APPLICATIONS

The present application is based on, and claims priority from, Taiwan Application Serial Number 93140351, filed Dec. 23, 2004, the disclosure of which is hereby incorporated by reference herein in its entirety.

BACKGROUND

1. Field of Invention

The present invention relates to a wafer electroplating apparatus. More particularly, the present invention relates to a wafer electroplating apparatus with functions of bubble removal and flow rectification.

2. Description of Related Art

Electroplating is to employ an object to be plated as a cathode, such as a semiconductor wafer, and a plating metal as an anode, such as titanium plated with platinum or titanium, and apply a voltage between the cathode and anode to allow metal to ionize. Metal ions are then deposed on the object to be plated, which increases the surface brightness and the corrosion resistance of the object to be plated. Following the rapid development of the integrated circuit (IC), the quality requirements for wafer electroplating is becoming more and more demanding for fulfilling the increasing needs of IC applications.

Bubbles may be generated during an electroplating process and circulate along with the electroplating solution in pipelines. Defects may be caused in the object to be plated due to the existence of these bubbles in the electroplating solution and becomes a main issue in an electroplating process. JP 2003-277986 disclosed a debubbler with functions of removing bubbles and flow rectification. However, the debubbler is a complicated structure and requires high cost and huge space, and an inbuilt area for bubble removal is also not convenient to be cleaned. There is another conventional electroplating apparatus equipped with a de-bubble tank below an electroplating bath, but many circulating dead spaces are present in the rectangular de-bubble tank which leads to exceptional deposition, unsymmetrical flow field and difficulty in cleaning.

Electroplating involves an electrochemical process in which exchange of ion charges occurs, that is, charge transfer. Therefore, flow field distribution of the electroplating solution has an impact on electroplating. Flow field distribution of the electroplating solution entering an electroplating bath is rendered unsymmetrical if the length of a pipe is insufficient or an angular deviation of the pipe exists. Unsymmetrical flow field distribution results in making the distributions of concentration and flow speed of the electroplating solution in the electroplating bath irregular and also influences uniformity in electroplating thickness. U.S. patent application Ser. No. US10/743,496 disclosed an electroplating apparatus to which a rectification device is added for rectifying the electroplating solution prior to entering an electroplating tank. The added height of the electroplating tank due to the built-in rectification device increases the required amount and cost of electroplating solution, and the presence of bubbles in the electroplating solution in pipes remains a factor in electroplating yield.

SUMMARY

It is therefore an objective of the present invention to provide an electroplating apparatus with a function of bubble removal to eliminate or reduce bubbles in an electroplating solution and thereby reduce electroplating defects.

It is another objective of the present invention to provide an electroplating apparatus with functions of bubble removal and flow rectification for reducing electroplating defects and allow for a better uniformity in electroplating thickness.

In accordance with the foregoing and other objectives of the present invention, a wafer electroplating apparatus is provided. The wafer electroplating apparatus comprises an electroplating bath main body providing an area for bubble removal and flow rectification and a fixing device having a structure for guiding the bubbles gathered at an air hole which is easily combined with the electroplating bath main body and separated therefrom.

In a preferred embodiment, the wafer electroplating apparatus further comprises an electroplating bath disposed in an upper part of the electroplating bath main body in which a wafer holder and an anode net-plate are placed, wherein the wafer holder is arranged at an upper part of the electroplating bath and the anode net-plate is arranged at a lower part of the same. The electroplating bath main body further comprises a first de-bubble tank, an air hole and an inlet device. The inlet device is disposed above the first de-bubble tank for an electroplating solution entering the electroplating bath. The air hole is disposed on an upper surface of the first de-bubble tank and extends to an outer surface of the electroplating bath main body. The fixing device comprises a second de-bubble tank and an outer shell.

In another preferred embodiment, the electroplating bath main body further comprises a baffle and a strut. An end of the strut is connected to the baffle and the other end is connected to the inlet device within the electroplating bath main body. The baffle is separated from an inner surface of the second de-bubble tank by a predetermined distance when the fixing device is combined with the electroplating bath main body.

The wafer electroplating apparatus according to the present invention allows for the electroplating solution passing through a de-bubble area formed by coupling between the first de-bubble tank and the second de-bubble tank. In addition to being a buffer area, the de-bubble area is used for guiding the electroplating solution with bubbles upwardly to a top of the de-bubble area to gather the bubbles and then exhaust the bubbles to an outside of the electroplating bath main body through the air hole, which removes the bubbles before a wafer is electroplated in the electroplating process.

Moreover, the attachment of the baffle allows the electroplating solution to pass along sides of the baffle to be prevented from entering the inlet device directly. The electroplating solution is buffered by the de-bubble area and the baffle prior to entering the inlet device which helps the flow field of the electroplating solution in pipes to gain a better uniformity of flow field of the electroplating solution entering the electroplating bath.

Further, the electroplating apparatus of the present invention is designed so that the electroplating bath main body is able to be combined with and separated from the fixing device, and therefore the electroplating apparatus is conveniently cleaned and maintained. According to the size of the wafer, an appropriate electroplating bath main body may be chosen to couple with fixing device. The de-bubble area is formed jointly by the second de-bubble tank in the fixing device and the first de-bubble tank in the electroplating bath main body, so that the height of the apparatus is lowered substantially and the electroplating solution is saved consequently.

These and other features, aspects, and advantages of the present invention will become better understood with reference to the following description and appended claims.

It is to be understood that both the foregoing general description and the following detailed description are by examples and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings where:

DESCRIPTION OF THE PREFERRED EMBODIMENTS

Figure 1A:
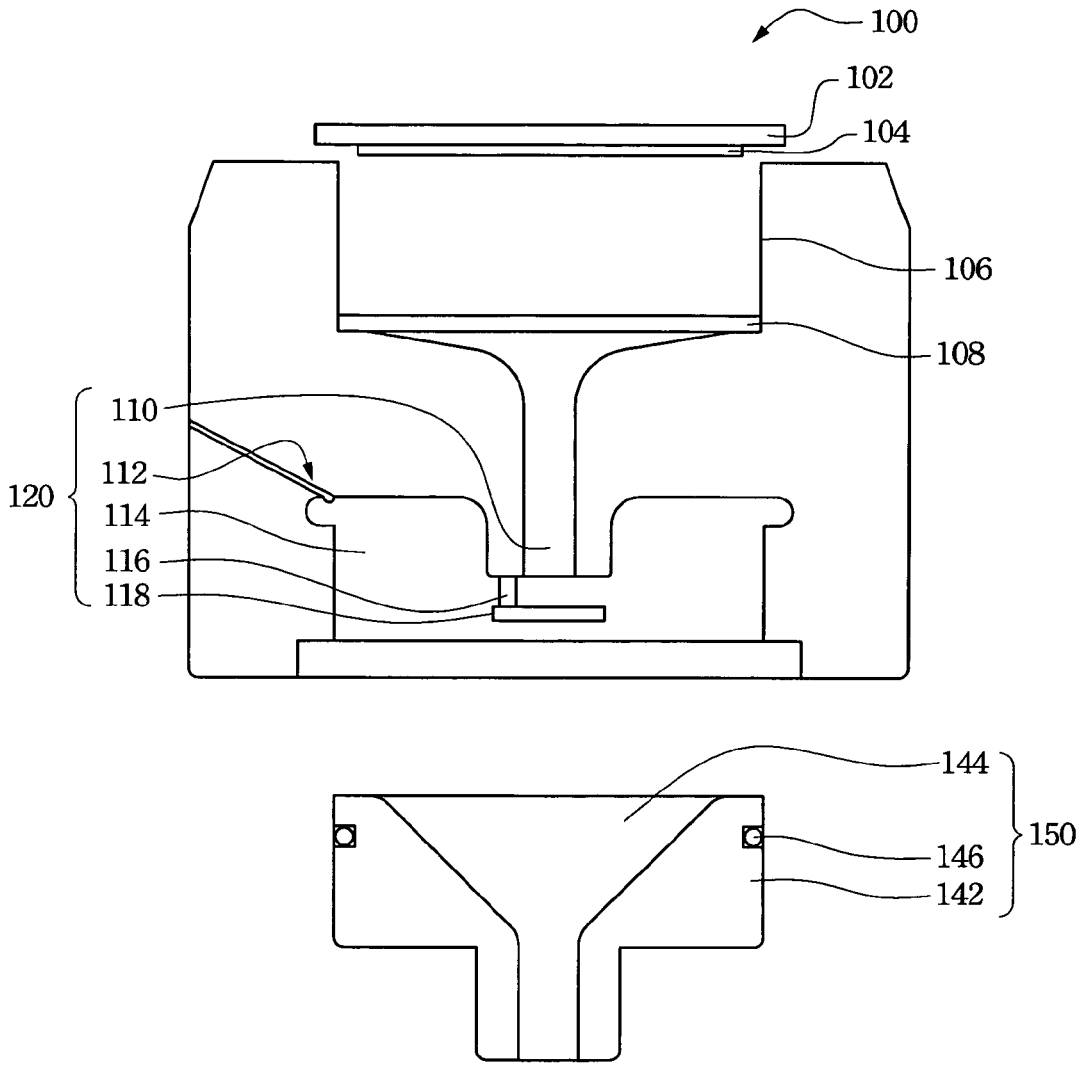
FIG. 1A is a cross-sectional view of a disassembled wafer electroplating apparatus in accordance with a preferred embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

Figure 1B:
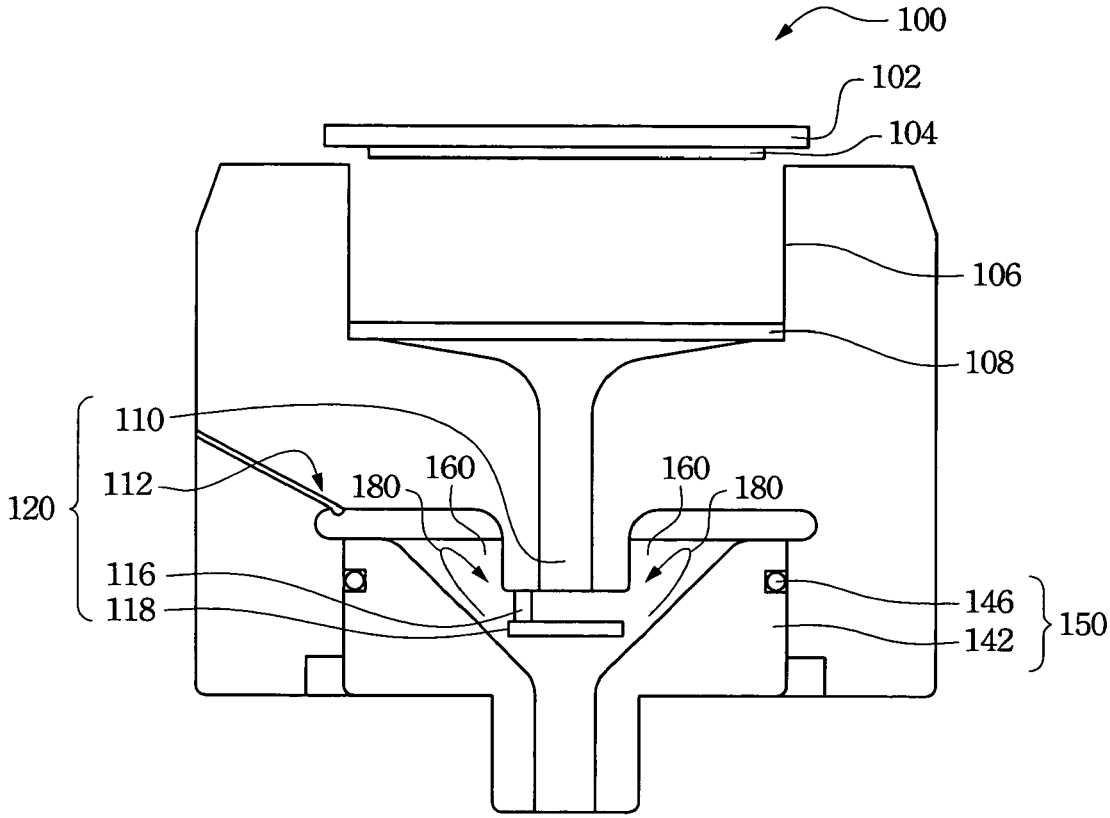
FIG. 1B is a cross-sectional view of an assembled wafer electroplating apparatus according to one preferred embodiment of this invention.

Referring to FIG. 1A and FIG. 1B, FIG. 1A is a cross-sectional view of a disassembled wafer electroplating apparatus 100 in accordance with a preferred embodiment of the present invention, and FIG. 1B is a cross-sectional view of an assembled wafer electroplating apparatus 100 according to one preferred embodiment of this invention. The wafer electroplating apparatus 100 includes an electroplating bath main body 120 and a fixing device 150. Further, an electroplating bath 106 is disposed in an upper part of the electroplating bath main body in which a wafer holder 102 and an anode net-plate 108 are placed. The wafer holder 102 is disposed in an upper part of the electroplating bath 106 and the anode net-plate 108 is disposed in a lower part of the electroplating bath 106. The wafer 104, such as a silicon wafer, is attached under the wafer holder 102.

The electroplating bath main body 120 comprises an inlet device 110, a first de-bubble tank 114 and an air hole 112. The air hole 112 has a size of about 0.5 mm. The fixing device 150 comprises a second de-bubble tank 144 and an outer shell 142. The outer shell further comprises an O-ring 146 for the electroplating bath main body 120 to couple tightly with the fixing device 150.

The inlet device 110 above the first de-bubble tank 114 is for the electroplating solution to flow through and then enter the electroplating bath 106. The air hole 112 is disposed on an upper surface of the first de-bubble tank 114 and extends to an outer surface of the electroplating bath main body 120. When the electroplating bath main body 120 is combined with the fixing device 150, the outer shell 142 is coupled to the first de-bubble tank 114 and a de-bubble area 160 is formed by a coupling of the first de-bubble tank 114 and the second de-bubble tank 144. When entering the electroplating bath main body 120, the electroplating solution with bubbles flows upward through the de-bubble area 160 and to an upper surface thereof, so that bubbles are gathered and then guided through the air hole 112 to an outside of the electroplating bath main body 120. The second de-bubble tank 144 may be a cone or other tapered structure.

The electroplating bath main body 120 further comprises a strut 116 and a baffle 118. An end of the strut 116 is connected to the inlet device 110 and the other end is connected to the baffle 118. The baffle 118 is disposed below the inlet device 110 and separated from an inner surface of the second de-bubble tank 144 by a predetermined distance. When entering the electroplating bath main body 120, the electroplating solution is blocked from entering the inlet device 110 directly but passes along sides of the baffle 118 instead, as flow direction 180 shows, so that the electroplating solution with bubbles flows upward and then the bubbles are gathered at an upper surface of the de-bubble area 160 and guided to an outside of the electroplating bath main body 120 through the air hole 112. A flow field of the electroplating solution without bubbles entering the inlet device 110 is more uniform due to a buffer by the de-bubble area 160. Preferably, if the baffle 118 is circular and its axis aligns with an axis of the inlet device 110, uniformity of the flow field will be enhanced. The baffle 118 may also be a symmetric square or polygon.

The wafer electroplating apparatus of the present invention is designed so that the electroplating bath main body is able to be combined with and separated from the fixing device. By using the wafer electroplating apparatus of the present invention, an extra bubble removal apparatus is not needed, thus reducing cost. Further, the first de-bubble tank and the second de-bubble tank form jointly the de-bubble area when the wafer electroplating apparatus is assembled, so that a height of the wafer electroplating apparatus is lowered and the electroplating solution is saved consequently. The wafer electroplating apparatus is conveniently cleaned and maintained due to its ability to be disassembled. The second de-bubble tank is, for example, a tapered structure, and preferably a cone for more convenience of cleaning.

According to a preferred embodiment of the present invention, the bubbles are gathered at an upper surface of the de-bubble area resulting from the electroplating solution and then are exhausted through the air hole during an electroplating process. Therefore, bubbles in the electroplating solution are reduced when electroplating and defects are decreased.

According to another preferred embodiment of the present invention, a baffle is attached so that the electroplating solution flow is more convergent toward an upper part of the de-bubble area which ensures a gathering of the bubbles, and the flow field of the electroplating solution becomes more uniform before entering the inlet device due to a rectification.

Also, the wafer electroplating apparatus of the present invention is designed to be assemble and disassemble, so that it is conveniently cleaned and maintained and an appropriate electroplating bath main body may be chosen according to the size of the wafer to couple with the fixing device. The first de-bubble tank and the second de-bubble tank jointly form the de-bubble area so that the height of the wafer electroplating apparatus is lowered and the electroplating solution is thus saved.

Although the present invention has been described in considerable detail with reference to certain preferred embodiments thereof, other embodiments are possible. Therefore, their spirit and scope of the appended claims should not be limited to the description of the preferred embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A wafer electroplating apparatus for removing bubbles in an electroplating solution during a wafer electroplating process, comprising:

an electroplating bath main body, comprising:

an inlet device;

a first de-bubble tank disposed in a lower part of said electroplating bath main body and connected to said inlet device; and an air hole disposed on an upper surface of said first de-bubble tank and extending to an outer surface of said electroplating bath main body; and a fixing device comprising a second de-bubble tank and an outer shell, wherein when said electroplating bath main body is combined with said fixing device, said outer shell is coupled to an inner surface of said first de-bubble tank and said second de-bubble tank couples with said first de-bubble tank to form a de-bubble area for guiding said electroplating solution to flow toward an upper part of the de-bubble area and therefore said bubbles in said electroplating solution are gathered and guided through said air hole to an outside of said electroplating bath main body.

2. The wafer electroplating apparatus of claim 1, wherein said air hole has a size of about 0.5 mm.

3. The wafer electroplating apparatus of claim 1, wherein said outer shell has at least an O-ring.

4. The wafer electroplating apparatus of claim 1, wherein said second de-bubble tank is a tapered structure.

5. The wafer electroplating apparatus of claim 4, wherein said tapered structure is a cone structure.

6. A wafer electroplating apparatus for flow rectification and removing bubbles in an electroplating solution during a wafer electroplating process, comprising:

an electroplating bath main body, comprising:

an inlet device;

a first de-bubble tank disposed in a lower part of said electroplating bath main body and connected to said inlet device;

an air hole disposed on an upper surface of said first de-bubble tank and extending to an outer surface of said electroplating bath main body; and a baffle below said inlet device for an electroplating solution being prevented from entering said inlet device directly but passing along sides of said baffle instead, and therefore being buffered before entering said inlet device; and a fixing device comprising a second de-bubble tank and an outer shell, wherein when said electroplating bath main body is combined with said fixing device, said baffle is separated from an inner surface of said second de-bubble tank by a predetermined distance, and said outer shell is coupled to an inner surface of said first de-bubble tank, and said second de-bubble tank couples with said first de-bubble tank to form a de-bubble area for guiding said electroplating solution flow toward an upper part of said de-bubble area and therefore said bubbles in said electroplating solution are gathered and guided through said air hole to an outside of said electroplating bath main body.

7. The wafer electroplating apparatus of claim 6, wherein said baffle is circular.

8. The wafer electroplating apparatus of claim 7, wherein an axis of said baffle aligns with an axis of said inlet device, so that said electroplating solution enters said inlet device as a uniform and symmetric flow.

9. The wafer electroplating apparatus of claim 6, wherein said air hole has a size of about 0.5 mm.

10. The wafer electroplating apparatus of claim 6, wherein said outer shell has at least an O-ring.

11. The wafer electroplating apparatus of claim 6, wherein said second de-bubble tank is a tapered structure.

12. The wafer electroplating apparatus of claim 6, wherein said baffle is connected with an end of a strut.

13. The wafer electroplating apparatus of claim 12, wherein the other end of said strut is connected to said inlet device.

14. A wafer electroplating apparatus, comprising:

an electroplating bath main body, comprising:

an electroplating bath disposed in an upper part of said electroplating bath main body in which a wafer holder and an anode net-plate are placed;

an inlet device below said electroplating bath;

a first de-bubble tank disposed in a lower part of said electroplating bath main body and connected to said inlet device;

an air hole disposed on an upper surface of said first de-bubble tank and extending to an outer surface of said electroplating bath main body; and a baffle below said inlet device for an electroplating solution being prevented from entering said inlet device directly but passing along sides of said baffle instead, and therefore being buffered before entering said inlet device; and a fixing device comprising a second de-bubble tank and an outer shell, wherein when said electroplating bath main body is combined with said fixing device, said baffle is separated from an inner surface of said second de-bubble tank by a predetermined distance, and said outer shell is coupled to an inner surface of said first de-bubble tank, and said second de-bubble tank couples with said first de-bubble tank to form a de-bubble area for guiding said electroplating solution flow toward an upper part of said de-bubble area and therefore said bubbles in said electroplating solution are gathered and guided through said air hole to an outside of said electroplating bath main body.

15. The wafer electroplating apparatus of claim 14, wherein said baffle is circular.

16. The wafer electroplating apparatus of claim 15, wherein an axis of said baffle aligns with an axis of said inlet device, so that said electroplating solution enters said inlet device as a uniform and symmetric flow.

17. The wafer electroplating apparatus of claim 14, wherein said air hole has a size of about 0.5 mm.

18. The wafer electroplating apparatus of claim 14, wherein said outer shell has at least an O-ring.

19. The wafer electroplating apparatus of claim 14, wherein said second de-bubble tank is a tapered structure.

20. The wafer electroplating apparatus of claim 19, wherein said tapered structure is a cone structure.

* * * * *